US009649869B2

(12) United States Patent
Klassen et al.

(10) Patent No.: US 9,649,869 B2
(45) Date of Patent: May 16, 2017

(54) BOOKBINDING BY INSERTING A HELICAL PLASTIC COIL INTO THE ALIGNED HOLES AT THE EDGE OF THE BOOK

(71) Applicant: Gateway Bookbinding Systems Ltd., Winnipeg (CA)

(72) Inventors: Walter D. Klassen, Winnipeg (CA); Matthew G. Desjarlais, Winnipeg (CA)

(73) Assignee: GATEWAY BOOKBINDING SYSTEMS LTD., Winnipeg, Manitoba (CA)

( * ) Notice: Subject to any disclaimer, the term of this patent is extended or adjusted under 35 U.S.C. 154(b) by 168 days.

(21) Appl. No.: 14/056,280

(22) Filed: Oct. 17, 2013

(65) Prior Publication Data

US 2015/0110578 A1 Apr. 23, 2015

(51) Int. Cl.
*B42B 5/12* (2006.01)

(52) U.S. Cl.
CPC ..... *B42B 5/123* (2013.01)

(58) Field of Classification Search
CPC . B42B 5/123; B42B 5/12; B42B 5/126; B21F 3/04; B21F 45/16
USPC ..... 412/10, 11, 16, 33, 39, 40; 140/92.3, 140/92.8, 92.94
See application file for complete search history.

(56) References Cited

U.S. PATENT DOCUMENTS 2,532,443 A * 12/1950 Freundlich ..... B42B 5/123 140/3 R
2,730,142 A * 1/1956 Berberich ..... B42B 5/123 140/92.3
2,836,203 A * 5/1958 Brook ..... B42B 5/103 140/71 R
3,378,046 A * 4/1968 Ostermeier ..... B42B 5/123 140/92.93
3,486,537 A * 12/1969 Sickinger ..... B42B 5/123 140/92.93
3,592,242 A * 7/1971 Sickinger ..... B42B 5/123 140/92.94

(Continued)

FOREIGN PATENT DOCUMENTS

CA 2429874 11/2004

OTHER PUBLICATIONS

Non-Patent Literature "A Step-by-Step Overview of binding with Akiles WireMac Duo" published at blog.bindingdepot.com on Jun. 27, 2011 (see p. 8-10; hereinafter "Akiles").*

*Primary Examiner* — Jimmy T Nguyen
*Assistant Examiner* — Peter Iannuzzi
(74) *Attorney, Agent, or Firm* — Adrian D. Battison; Ryan W. Dupuis; Ade & Company Inc.

(57) ABSTRACT

A helical coil is inserted into holes at an edge of a book by a machine which is adjustable for different diameters of coil. The face of the book sits on a platen and the coil is driven by a roller while the edge of the book is supported on a plurality of spine formers having an arced surface for shaping the edge of the book and an end of the book is engaged by a side lay member at an angle to incline the holes at the angle to receive the turns of the coil. The flat spine formers are carried on supports which rotate so as to allow the turns of the coil at the pitch angle to pass the spine formers. For different book thickness and coil diameter, the arced shape of the spine formers, the spine former angle and the lay angle are changed manually.

20 Claims, 9 Drawing Sheets

(56) References Cited

U.S. PATENT DOCUMENTS

| | | | | |
|---|---|---|---|---|
| 3,793,660 | A * | 2/1974 | Sims | B42B 5/103 412/40 |
| 6,000,897 | A | 12/1999 | DesJarlais | |
| 6,036,423 | A * | 3/2000 | Westra | B42B 5/123 412/38 |
| 6,527,016 | B2 * | 3/2003 | Todaro | B42B 5/123 140/92.93 |
| 7,246,982 | B2 | 7/2007 | Desjarlais et al. | |
| 7,731,468 | B2 | 6/2010 | Desjarlais et al. | |
| 8,287,205 | B2 | 10/2012 | Desjarlais et al. | |
| 2004/0218996 | A1 * | 11/2004 | Fuchs | B42C 5/02 412/33 |
| 2008/0095596 | A1 * | 4/2008 | Spiel | B42F 5/04 412/40 |
| 2008/0142110 | A1 * | 6/2008 | Holder | B21F 1/00 140/106 |
| 2009/0229698 | A1 * | 9/2009 | Chiang | B42B 5/123 140/92.3 |
| 2014/0017039 | A1 * | 1/2014 | Chiang | B42B 5/12 412/16 |

* cited by examiner

| Coil Size | | 50 | 45 | 42 | 38 | 35 | 32 | 30 | 28 | 25 | 23 | 22 | 20 | 19 | 18 | 17 | 16 | 15 | 14 | 13 | 12 | 11 | 10 | 9 | 8 | 7 | 6 |
|---|---|---|---|---|---|---|---|---|---|---|---|---|---|---|---|---|---|---|---|---|---|---|---|---|---|---|---|
| 0.2475 Pitch | Sidelay Angle | | | | | | | 1 | 1 | 1 | 2 | 2 | 2 | 2 | 2 | 3 | 3 | 3 | 3 | 3 | 4 | 4 | 4 | 5 | 5 | 5 | 5 |
| | Spineformer Angle | | | | | | 72 | B | B | B | C | C | C | C | D | D | D | D | D | E | E | E | E | E | E | E | E |
| 3:1 Pitch | Sidelay angle | 1 | 1 | 1 | 1 | 1 | 2 | 2 | 2 | 2 | 3 | 3 | 3 | 3 | 3 | 4 | 4 | 4 | 73 | | | | | | | | |
| | Spineformer Angle | A | B | B | B | B | C | C | C | C | D | D | D | D | E | E | E | E | | | | | | | | | |
| 2.5 : 1 Pitch | Sidelay angle | 1 | 1 | 1 | 2 | 2 | 2 | 2 | 3 | 3 | 3 | 3 | 4 | 4 | 4 | 4 | 4 | 5 | 74 | | | | | | | | |
| | Spineformer Angle | B | B | B | C | C | C | D | D | D | D | E | E | E | E | E | E | E | | | | | | | | | |

71

70

Fig. 8

BOOKBINDING BY INSERTING A HELICAL PLASTIC COIL INTO THE ALIGNED HOLES AT THE EDGE OF THE BOOK

This invention relates to the insertion of plastic coils into aligned holes at the edge of a collated book for binding the book.

BACKGROUND OF THE INVENTION

In U.S. Pat. No. 6,000,897 of Desjarlais issued Dec. 14, 1999 is disclosed a machine for inserting a plastic coil into aligned holes at the edge of a book for binding of the book. Such coils are formed of a plastic filament which is wound into a helical coil. Coils of different diameters can be selected for different thicknesses of book with the diameters commonly available lying in the range 6 mm to 30 mm.

In U.S. Pat. No. 7,246,982 issued Jul. 24, 2007 which corresponds to Canadian application Serial No: 2,429,874 filed May 27, 2003, entitled BOOKBINDING COIL INSERTION MACHINE is disclosed an improved arrangement of this type which includes a gauge for automatically setting the spacing of the platen from the drive roller in dependence on a measured diameter of the coil.

In U.S. Pat. No. 7,731,468 issued Jun. 8, 2010 entitled BOOKBINDING COIL END CUTTING AND CRIMPING MACHINE is disclosed a machine for cutting and crimping the ends of a helical coil inserted into holes at an edge of a book to hold the coil in place and is adjustable to accommodate different diameters of coil. A guide member for centering the axis of the coil in a centering direction is adjustable to accommodate different diameter coils and for adjusting the location of the axis in an adjustment direction at right angles to the centering direction depending upon the diameter of the coil. A cutting device has a blade movable in a slot of an anvil to shear on one side and to bend on the other side to form a crimped end portion. The adjustment of the axis causes the cutting device to cut the end portion longer for larger coils. The cutting device is adjustable to rotate the anvil relative to the axis to accommodate different helix angles In U.S. Pat. No. 8,287,205 issued Oct. 16, 2012 entitled METHOD FOR BINDING A BOOK WITH A HELICAL PLASTIC COIL is disclosed an arrangement in which a leading end of the helical plastic filament is fed into a first hole at a first end of the book and the coil is rotated about its axis such that the leading end is threaded through the holes by entering each of the holes until the coil is threaded through all of the holes. The leading end of the coil is sheared by an anvil and blade so as to define a leading apex and a leading surface inclined rearwardly from the leading apex along the filament and across the filament. The leading apex is arranged such that, as the leading end enters each of the holes in turn, the leading apex is located on the leading end of the filament at a position thereon facing away from the trailing end of the coil and spaced from the end of the hole facing the first end of the book.

The disclosures of the above patents are hereby incorporated herein by reference or may be referenced for further details of the machine not included herein.

All of these patents provide an arrangement for inserting the coil into the book which is automated and is thus generally more suitable for longer production runs where the cost of the machine can be justified.

In other lower cost situations such as in smaller offices or in low production runs it is common to use either manual insertion of the coil or to use a roller or belt drive system to assist in coil insertion where the operator holds the book in place at the drive system till the frictional contact between the coil and the drive moves the coil to the required location. Such devices do not include a cutting and crimping device since the complexity is not suitable for the low cost drive system.

In order to effect the cutting and crimping action, therefore, the operator can use a manual cutting tool in the form of a pair of specially designed pliers.

Previous devices have been provided for receiving the book and coil and for cutting and crimping the ends of the inserted coil. The operator holds the book in place and the device has a cutter device which is driven by suitable motive force such as pneumatics to effect the cutting action.

Typical machines are in coil size to the range 6 to 20 mm or 30 mm and cannot therefore operate with, or at least have difficulty in operating with, coils in the range 30 to 50 mm which are commonly available and these machines suffer from this clear and severe restriction.

SUMMARY OF THE INVENTION

It is one object of the invention to provide a machine of the above general type which is improved to allow the insertion of coils in the range 6 to 50 mm by adjustment of the machine.

According to a first aspect of the invention there is provided a method for inserting a plastic pre-formed helical coil into aligned holes at an edge of a collated book for binding the book, the book having two opposed faces and two opposed ends between which the edge extends, the helical coil having a plurality of turns extending around an axis of the coil at a pitch angle inclined to a radial plane of the axis;

the method comprising:

engaging one of the opposed faces of the collated book with a support surface of a platen having an edge at which the edge of the book is presented;

supporting the helical coil at the edge of the platen and engaging the coil with a drive roller for rotating the helical coil about an axis of the coil parallel to the edge of the platen;

engaging the edge of the book with a plurality of spine formers arranged at spaced positions along the edge of the platen, each spine former extending across the edge of the book and having an arced surface with an arced shape for shaping the edge of the book into the arced shape so that each of the holes follows a required arc of the hole for receiving the coil;

engaging one of the two opposed ends of the book with a side lay member so as to form said end into an inclined surface at a lay angle to a line at right angles to the platen so as to incline the holes at the angle to receive the turns of the coil;

arranging the spine formers on spine former supports at a spine former angle to a line at right angles to the faces of the book so as to allow the turns of the coil at said pitch angle to pass the spine formers;

and, for different thickness of books and different diameter of coils, changing the arced shape of the spine formers, changing the spine former angle of the spine formers and changing the lay angle of the side lay member.

Preferably the spine formers supports are rotated to change the spine former angle. The rotation is preferably carried out manually but could be automatic or processor controlled.

Preferably the spine former supports are arranged to rotate the spine former thereon with the axis of rotation arranged along the front face of the book.

That is, preferably each of the spine former supports comprises a pivoting mounting member which can be set to a spine former angle needed for the book that is to be bound. Preferably the pivoting mounting member is designed to rotate about a neutral axis, which can be the axis above, so that the pitch spacing between each spine former and the next is maintained for all coil sizes and pitches.

In accordance with one important feature of the invention, there are two spine formers and more than two supports for selection of the supports which are arranged to receive the two spine formers depending on the length of the edge of the book.

In accordance with another important feature of the invention, there can be provided a supply of different spine formers which are separate from the supports and those spine formers providing a required arc shape are manually selected from the supply and mounted on the supports.

Preferably the spine formers lie in a flat plane, that is they are formed from a flat plate. The flat plate in the plane can then be rotated as above.

The flat plate forming the spine former preferably includes edges thereof defining a first edge portion forming said arced surface, a second edge portion engaging said one of the opposed faces of the book and a third edge portion engaging said platen.

In accordance with another important feature of the invention, the platen is mounted for pivotal movement about an axis parallel to the edge of the book to different platen angles so as to change a distance between the edge of the platen and the drive roller and the spine formers include an edge portion thereof engaging the platen at an edge thereof remote from the axis for locating the edge of the platen at a required platen angle.

Preferably the edge of the platen is free from guide teeth so that the coil is not guided in its movement by the platen. To assist with guiding the coil in the absence of the teeth or conventional guide comb, the coil is preferably rotated is a direction so that the end of the coil enters the holes from an end of the hole at the face of the book remote from the platen so that the end of the coil can be guided into the first holes at the front of the book by manual manipulation. This provides an arrangement which is semi-automatic in that the construction is much simplified and uses the manipulative skill of the operator to make up for the reduction in automation.

Again for semi-automatic operation, there is preferably provided a chart listing a series of different coil sizes and different book thicknesses in conjunction with a list of manual adjustment positions for manual adjustment of the spine former angle of the spine formers and the lay angle of the side lay member. Preferably this arrangement is helped by the provision of a book thickness gauge for providing information relating to the book thickness for the chart.

In accordance with another important feature of the invention, the machine is arranged for use with coils having preferably three different pitches of 0.2475 inch, 0.333 inch (3:1) and 0.4 inch (2.5:1) and the spine formers are located at spaced positions arranged along the length of the edge of the book with the positions selected such that the spine formers allow the passage of each of the three pitches without interfering with movement of the coils. This requires a calculation of the positions along the book edge from the start position or coil entry position defined by the end lay member which allow the presence of the spine former while avoiding the spine former interfering with the rotation of the coil at the particular pitch concerned.

As an alternative to the preferred set of pitches of 0.02475, 0.333 inch and 0.4 inch there is a secondary set of pitches which include 0.250 inch, 0.333 inch and 0.40 inch spacings. The application of the alternative set of pitches is accomplished by supplying a different spine former mounting member which incorporates the pitch spacing that is optimized for the 0.250 inch spacing or other spacings to be selected.

Preferably the spine formers are shaped with an increase in the length of the arced spine former surface to allow the operator to split the book by pivoting one part of the book forwardly away from the platen around the arced surface of the spine former. This divides the book into two or more portions which act to improve the clearance for the coil as it is inserted into the book.

The machine is designed to handle the full range of coil sizes that are typically used in Plastic Coil Bookbinding. This range of sizes covers 6 mm to 50 mm diameters. Generally smaller coils are made with a smaller pitch spacing and larger coils are of a larger spacing.

The pitch that is used is determined by the punching of the holes in the paper. A larger pitch spacing allows the punch size to be larger and this is preferred for larger book thicknesses, as it makes it easier to insert the coil into a larger hole.

The coil drive rollers can be adjusted by using the coil as the gauge to set the roller relationship as described in U.S. Pat. No. 7,246,982 above.

The book is shaped by the use of a spine-former as described in U.S. Pat. No. 6,000,897 above. Utilizing spine-formers to shape the book is important for books that have tabs or oversized covers because these would prevent shaping the book by using the open edge. Oversize covers and tabs are more common on thicker books.

On existing machines, using a spine-former has required that the mechanism to locate/mount the spine-formers be a unique assembly for each pitch that is to be bound. Many machine that use spine-formers can only handle one pitch or they must have interchangeable inserts to accommodate each specific pitch. This new machine has been designed to accommodate a group of pitches with one configuration of spine-former mounting. That is, the commonly used pitches of 0.2475 inch, 0.333 inch (3:1) and 0.4 inch (2.5:1) can all be bound with one spine-former mounting assembly. The 0.2475 inch, 0.333 inch and 0.40 inch combination is the preferred embodiment, alternately there is a second combination which also can be employed consisting of 0.250 inch, 0.333 inch and 0.400 inch.

The spine-formers on current machines must be bent or twisted and mounted at a specific angle that is only applicable to one pitch and is not optimal for other pitches. The efficient binding of books that have been punched with different pitches would require multiple spine-formers bent at unique angles.

The new machine has been designed to utilize a flat spine-former that is mounted to a pivoting mounting block which can be set to whatever angle is needed for the book that is to be bound. Also the pivoting mount is designed to rotate about a neutral axis so that the pitch spacing is maintained for all sizes and pitch configurations.

The spine-formers also support the platen and are designed to adjust or set the book, coil and roller relationships automatically without the operator needing to make adjustments.

Also the relationships between the coil and book are not the same for thinner and thicker books. This design allows for specific relationships to be applied for each book that is being bound.

The design has the feature that permits the adjustment of the coil to roller clearance to optimize the coil insertion process and accommodate different coil tolerances or profiles.

The design incorporates an adjustable side-lay which can be set to the required angle for the particular pitch of the book that is to be bound. Previous designs utilize a fixed angle Side-lay which cannot accommodate the full range of books that need to be bound.

The design is based on the concept that the leading tip of the coil enters the punched hole of the book at the front of the machine. This allows the operator to guide the coil into the book for the first few loops of the coil. Also, if there are difficulties with insertion the operator can-guide/assist the coil into the punched hole.

BRIEF DESCRIPTION OF THE DRAWINGS

One embodiment of the invention will now be described in conjunction with the accompanying drawings in which:

FIG. 8 is schematic illustration of the chart which provides the settings to be manually applied to the side lay member and the spine former supports.

In the drawings like characters of reference indicate corresponding parts in the different figures.

DETAILED DESCRIPTION

Figure 1:
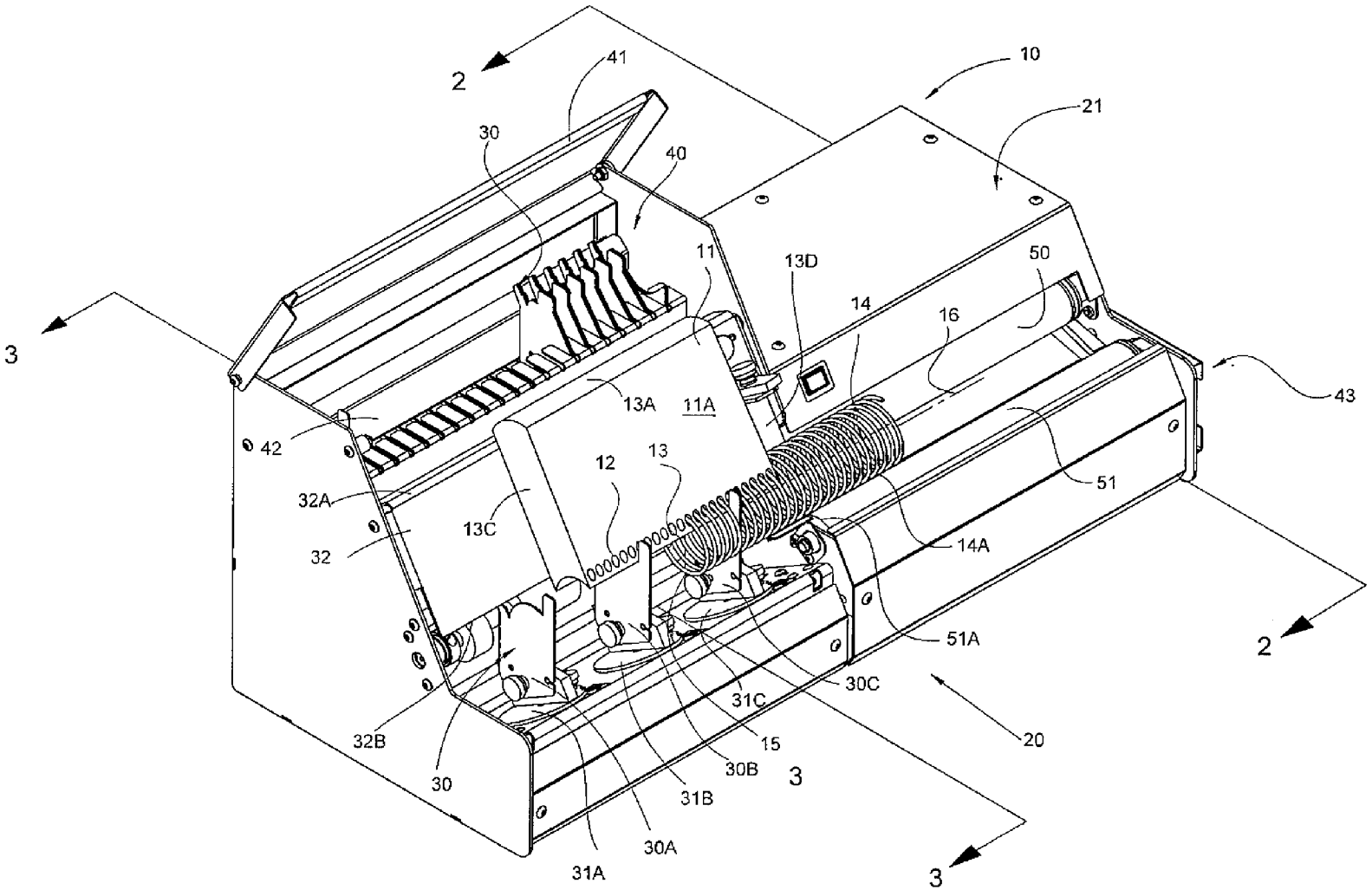
FIG. 1 is an isometric view of a machine for book binding for operating a method according to the present invention.
Figure 2:
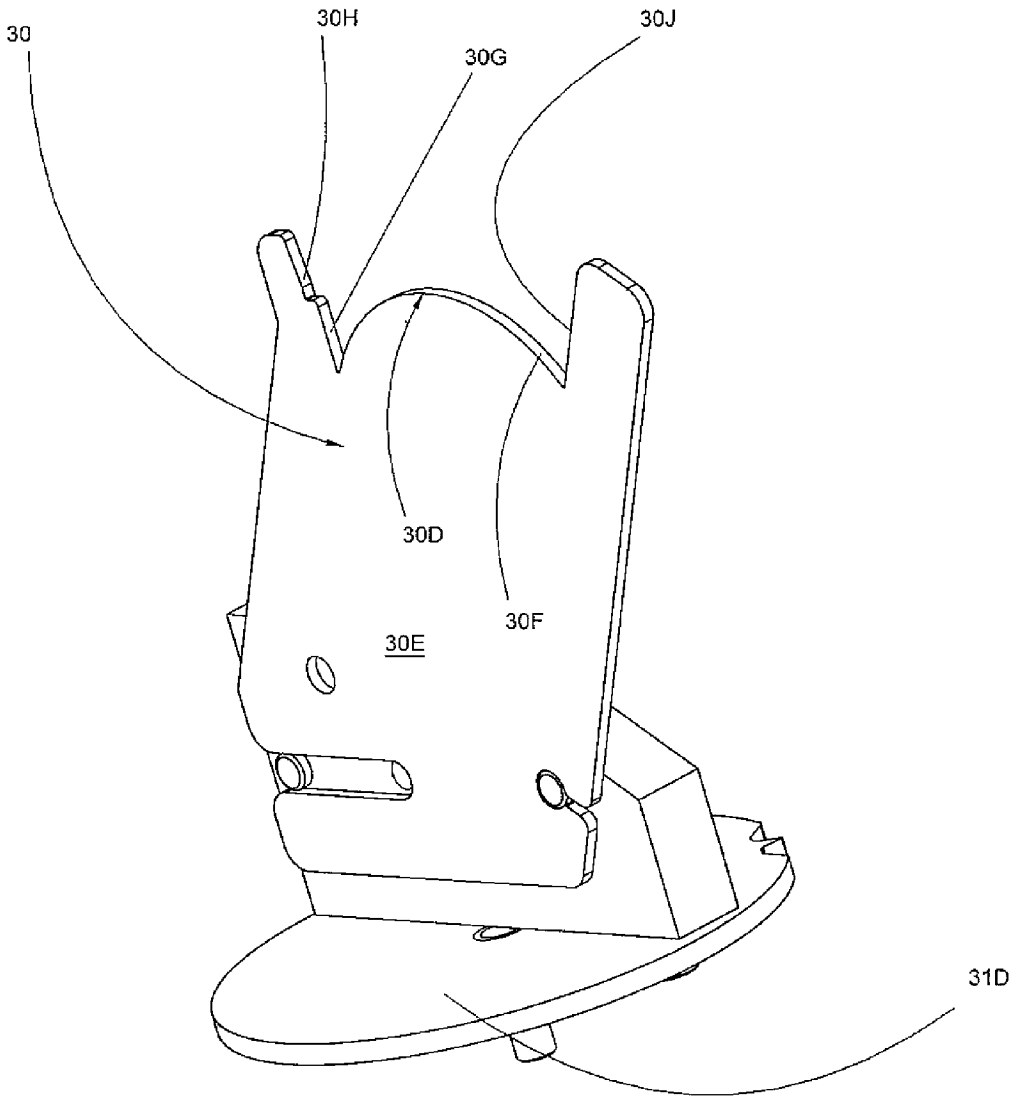
FIG. 2 is an enlarged view of one of the spine formers of FIG. 1.
Figure 3:
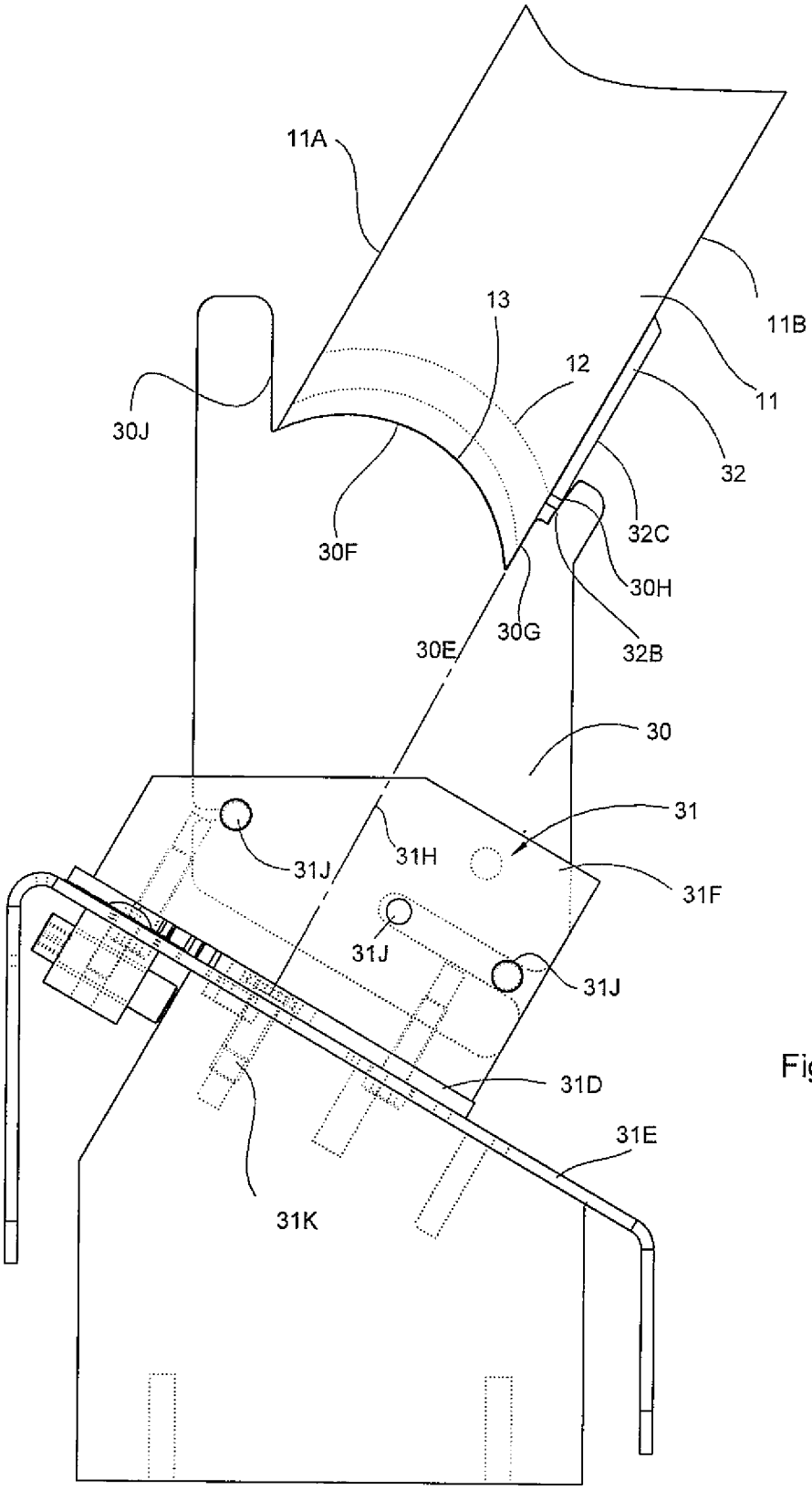
FIG. 3 is a cross-sectional view along the lines 3-3 of FIG. 1 showing the relationship of the spine former mount and the spine former of FIG. 2.
Figure 4:
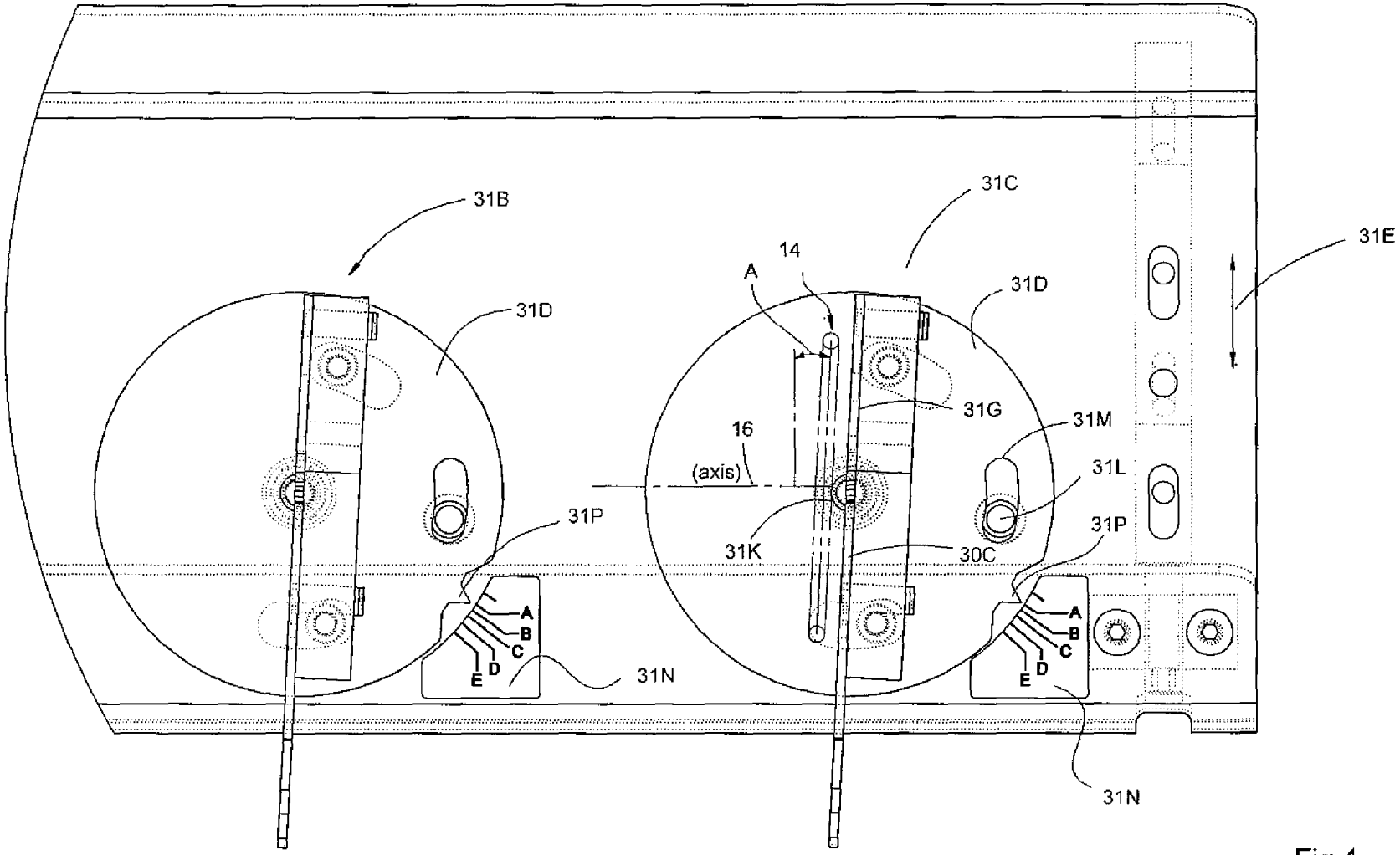
FIG. 4 is a top plan view of the spine formers of FIG. 3.

The machine for inserting plastic coils into aligned holes at the edge of a collated book for binding the book is indicated in FIG. 1 generally at 10.

Such bound books are conventionally well known where a collated stack of pages 11 to form the book has holes 12 cut along one edge 13 of the book with the holes in a row along the edge and the holes of each page stacked so that the coil 14 can pass through all of the pages. Thus it is well known that such a coil 14 can be inserted by inserting the end 15 of the coil in a first of the holes and by rolling the helical coil around its axis 16 so as to feed it along the edge of the book with the end 15 passing through each hole in turn until the coil is inserted all of the holes and two ends of the coil stand proud of the ends of the book.

It is well known that such coils can vary in diameter from a smallest coil which is conventionally used of the order of 6 mm in diameter to a largest coil which is conventionally used which is 50 mm in diameter. Such coils have a different helix angle so that the angle of the filament to the radial plane of a 6 mm coil is larger than the angle A of the filament to the radial plane of a 50 mm coil. This angle of course varies as the pitch of the helix varies. It is also commonly known that the coils are formed of filament which is of a higher gauge or thickness for the larger coils than the filament that is used for the smaller coils.

In the arrangement of the present invention the intention is to provide a device which receives the bound book where the ends of the coil project beyond the ends of the book after initial insertion.

In part of the complete binding process, it is necessary to cut and crimp the ends of the coil. However in this method, this action can be carried out manually or by other devices not shown which do not form part of the present method. Thus the ends of the coil are cut to a required length so that the amount of coil projecting beyond the end of the book is reduced and secondly an end most portion of the filament must be crimped at an angle to its length so as to hold the coil against rotation around its axis relative to the book which will cause the coil to come unbound.

Existing machines are available to assist the operator in inserting the coil into the edge of the book. The present machine is proposed for use with coil insertion machines which do not utilize an integrated cutting and crimping system. Simple machines for inserting the coil are widely available for use in facilities where lower production numbers are required. Such machines are commonly easy to set up and may, in many cases, simply comprise a pair of rollers so that the operator presses the coil against the roller so that the rollers rotate the coil around its axis in the threading action.

The machine shown in FIG. 1 comprises a frame 20 for standing on a suitable support and containing the components of the machine including drive components within a housing portion 21 which are not shown.

The book 11 comprises a stack of collated pages to be bound and includes two opposed faces 11A and 11B defined by front and rear pages of the book. The book further includes the edge 13 at which the holes 12 are located and an opposed edge 13A together with two opposed ends 13C and 13D between which the edge 13 extends.

The helical coil 14 has a plurality of turns 14A extending around an axis of the coil at a pitch angle A inclined to a radial plane of the axis 16 of the coil.

The components of the machine for holding the book include a plurality of spine formers 30A, 30B and 30C mounted on supports 31A, 31B and 31C. The spine formers are formed from a flat plate 30E lying in a flat plane and defining a support edge 30D defined by an edge of the plate 30E. Each of the spine formers 30 includes the support edge thereof defining a first edge portion 30F forming an arced surface for supporting the edge 13 of the book in a required arc. The edge 30D further includes a second edge portion 30G at the rear end of the arced edge 30F and upstanding therefrom so as to be arranged for engaging the rear face 11B of the book.

The spine formers 30 cooperate with a platen 32 in the form of a flat plate supported at the front of the frame and inclined forwardly and downwardly at a suitable angle so that the operator can place the rear face of the book against the platen. The platen 32 extends along the full length of the largest book to be bound and is hinged at a top edge 32A of the platen so that a bottom edge 32B of the platen can pivot forwardly away from a rearwardmost position against the frame to a forward position depending on the size of the book to be bound. The edge 32B of the platen is free from guide teeth so that the coil is not guided in its movement by the platen.

The edge 30D of the spine formers further includes a third edge portion 30H spaced rearwardly from the edge portion 30G so as to be arranged for engaging a rear face 32C of the platen 32 adjacent the bottom edge 32B. The thickness of the platen is equal to the spacing between the surfaces 30G and 30H so that the edge 30G is substantially coplanar with the platen to engage and support the rear face of the book.

The bottom edge of the platen is thus located by its engagement with the edges 30H on which the platen sits so that the angle of the platen can be adjusted in dependence on the position of the edge 30H.

The edge 30D of the spine formers further includes an edge portion 30J which stands upwardly from the arc edge 30F and can locate a position of the front face of the book. This edge therefore defines the width of the edge 30F which can be arranged to be approximately equal to the thickness of the book or can be greater so as to allow the front part of the book to be tilted forwardly away from the rear face.

Each of the spine formers is carried on a respective one of a plurality of the supports 31A, 31B and 31C each of which is individually adjustable. Each support comprises a base plate 31D which is mounted on a main mounting plate member 31E which carries all of the supports in a row across the front of the platen. The base plate 30D carries an upstanding boss 31F with a side support surface 31G to which the plate forming the flat spine formed is bolted by fasteners 31J at a fixed position. This presents the edge 30D upwardly in front of the platen 32. The base plate 31D and therefore the support plate 31E is at right angles to a line 31H along the edge 30G and therefore lying in the plane of the rear face of the book and in the plane of the spine former. The base plate 31D is carried on the support plate 31E on a mounting pin 31K for rotation of the base plate 31D about the axis 31H. This rotation is controlled by guide pins 31I in guide slots 31M so as to control the angle of rotation of the base plate and therefore the angle of the plate of the spine former about the axis 31H.

The angle of adjustment is set by a gauge 31N carried on the support plate 31E which cooperates with a marker 31P on the base plate 31D. The supports 31 are movable independently of one another and adjustable manually to the required angle as determined by the gauge 31N. This adjustment acts to change the spine former angle relative to a radial plane of the axis 16 of the coil so as to adjust the plate of the spine former to lie in a plane matching the plane of the turns of the coil.

Typically only two spine formers are used and these are placed in one of the three spine former supports for selection of the position of the spine formers on the supports depending on the length of the edge of the book. That is one spine former is placed in support 31C and one in either support 31A or 31B depending on whether the book edge is long enough to reach support 31A or is shorter.

In a container 40 with a lid 41 above the platen is provided a rack 42 defining a supply of different spine formers 30 which are separate from the spine former supports 31. The supply defines a number of different spine formers providing a different required arc shape for different thickness of books to be bound. This rack is associated with a gauge 43 which is used to manually check the book thickness and this is used to determine the diameter of coil to be used in binding the book. Based on the coil diameter, a particular pair of spine formers is selected from the rack and the selected spine formers are manually mounted on the spine former supports.

The coil is driven for rotation of the turns of the coil into the aligned holes at the edge of the book by a pair of rollers 50 and 51 on which the coil sits so as to present the coil to the edge of the book at the edge of the platen and on top of the spine former.

The roller 50 behind the platen is fixed and the relative positions of the roller 50 and the platen and the spacing therebetween which must be adjusted for different coil sizes is adjusted by the above described pivotal movement of the platen controlled by the shape of the spine former selected.

The roller 51 in front of the platen is adjusted relative to the roller 50 and the platen by mounting the roller 51 on the forward end 54 of an arm 53 pivotal around an axis of a mounting pin 52 and locked in position by a manual screw 55. The size of the coil selected can be measured in a gauge 56 which automatically locates the position of the arm 53 to place the roller 51 at the required position.

The roller 51 extends only up to an end 51A at the leading end of the book. The roller 50 extends beyond the end of the book behind the book to an end 50A and includes a plurality of separate sections 50B, 50C. 50D and 50E which are spaced each from the next to leave spaces to accommodate the spine formers 30.

Figure 5:
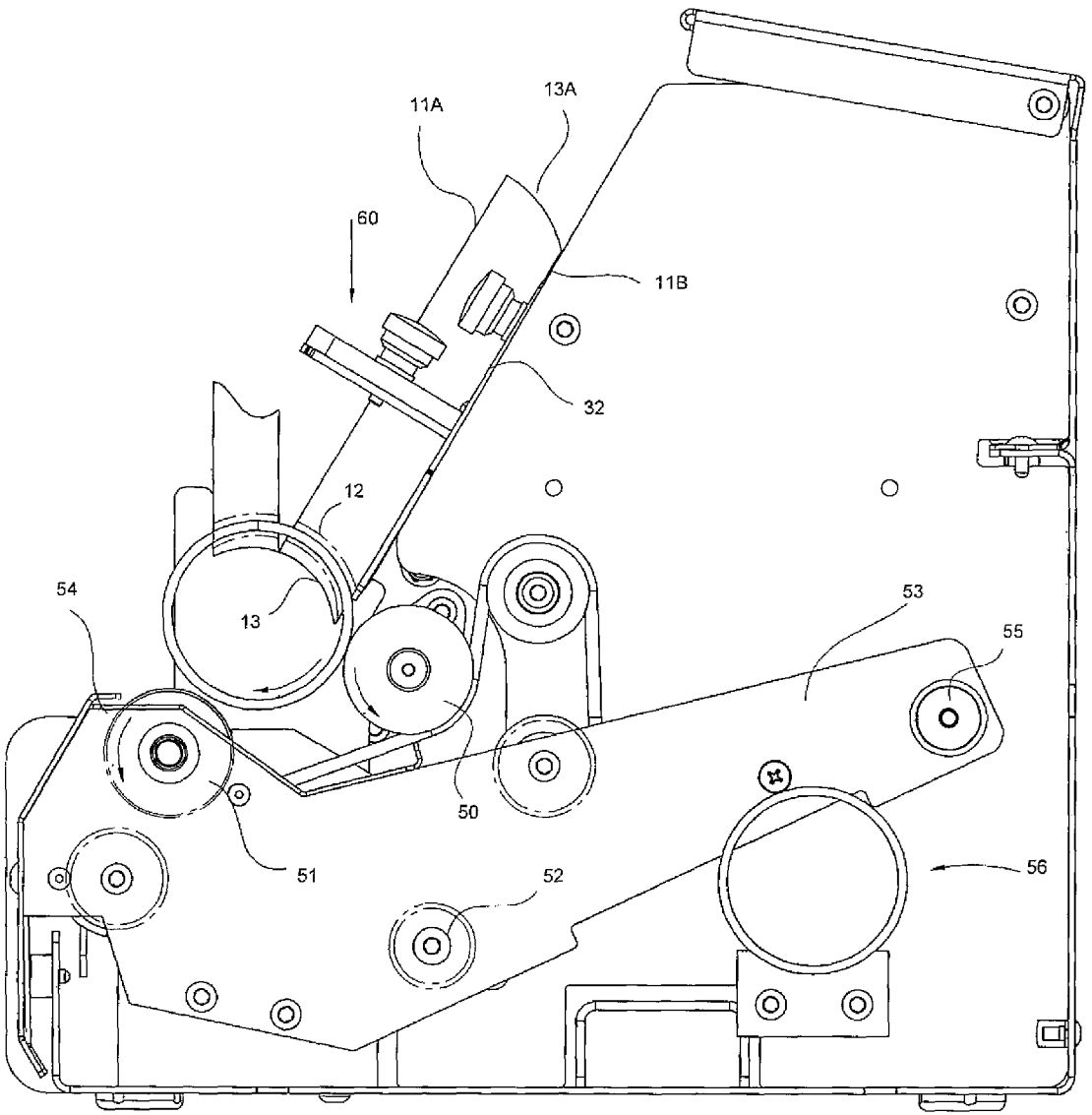
FIG. 5 is a cross-sectional view along the lines 2-2 of FIG. 1 showing the relationship of the gauge member and the rollers in relation to a coil of a larger diameter and showing the splitting of the book on the spine former.
Figure 6:
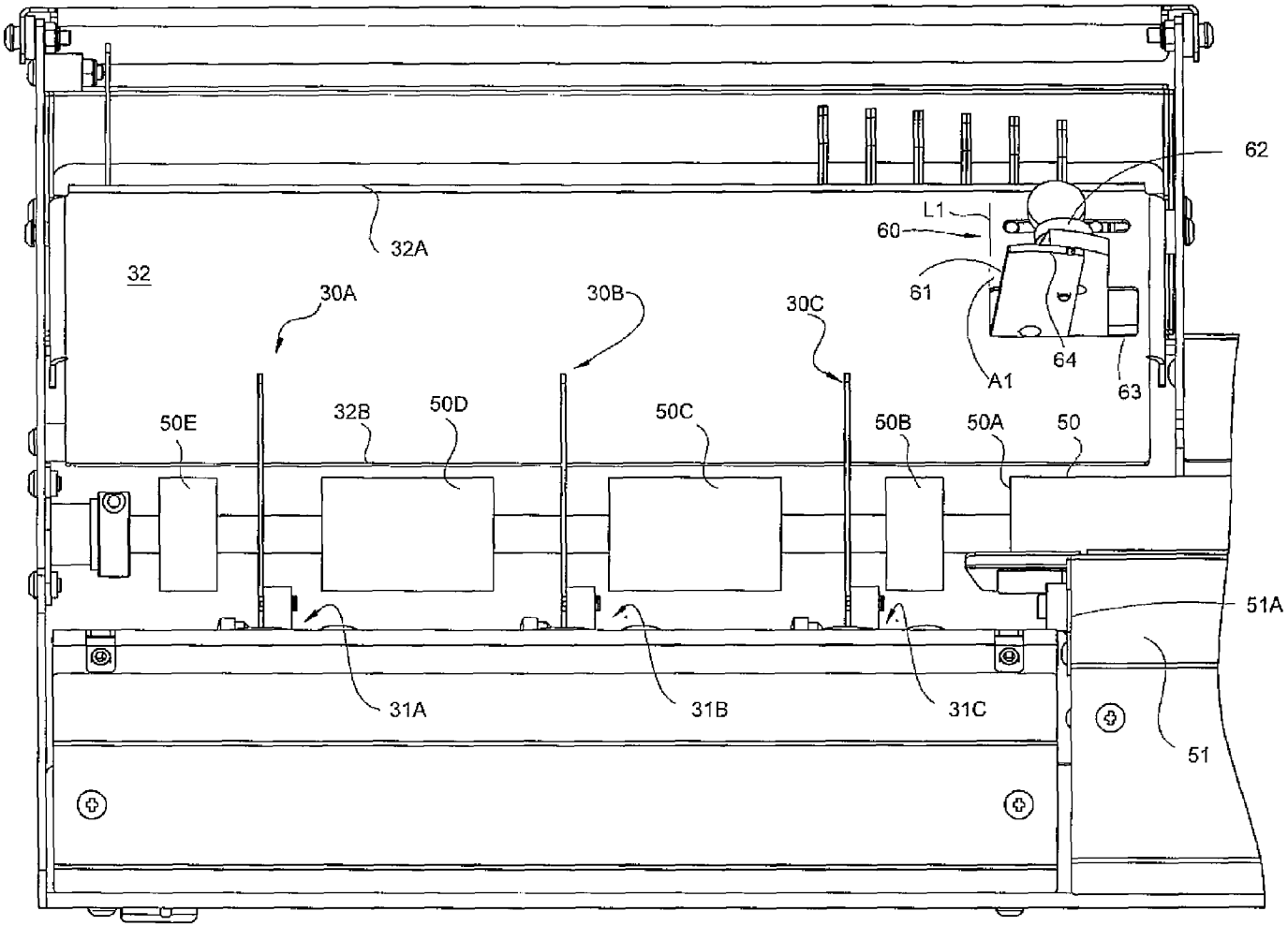
FIG. 6 is a front elevational view of the machine of FIG. 2.

The rollers rotate in a direction which is counter-clockwise as shown in FIG. 5 so as to drive the coil in a direction so that the end of the coil enters the holes 12 from an end of the hole at the face 11A of the book remote from the platen.

There is also provided a side lay member 60 which includes an edge 61 to engage the end 13D of the book so as to form the end 12D and the pages defined thereby into an inclined surface at the lay angle. The lay angle of the end of the book sets the angles of the holes and is arranged to define an angle A1 to a line L1 at right angles to the platen 32 so as to incline the holes 12 at the angle A1 to receive the turns of the coil. The angle of the edge of the side lay member is adjustable by manually setting using a gauge 64 and a setting screw 62.

As shown in FIG. 8, there is provided a chart 70 which can be attached inside the lid 41 to provide information to the user for setting the spine former angle at the gauge 31N and the side lay angle at the gauge 64. Thus the chart 70 includes a first row 71 listing a series of different coil sizes which are associated with different book thicknesses. This row is aligned with further rows 72, 73 and 74 associated with particular pitches which the coil sizes can have. That is each coil diameter can have 2 or 3 different coil pitches. Each selection of coil diameter and coil pitch provides a value to be set on the gauge 31N of the spine former supports and a value to be set on the gauge 64. That is each the set of coil diameters and pitches provides a list of adjustment positions for manual adjustment of the spine former angle of the spine formers and the lay angle of the side lay member.

Figure 7:
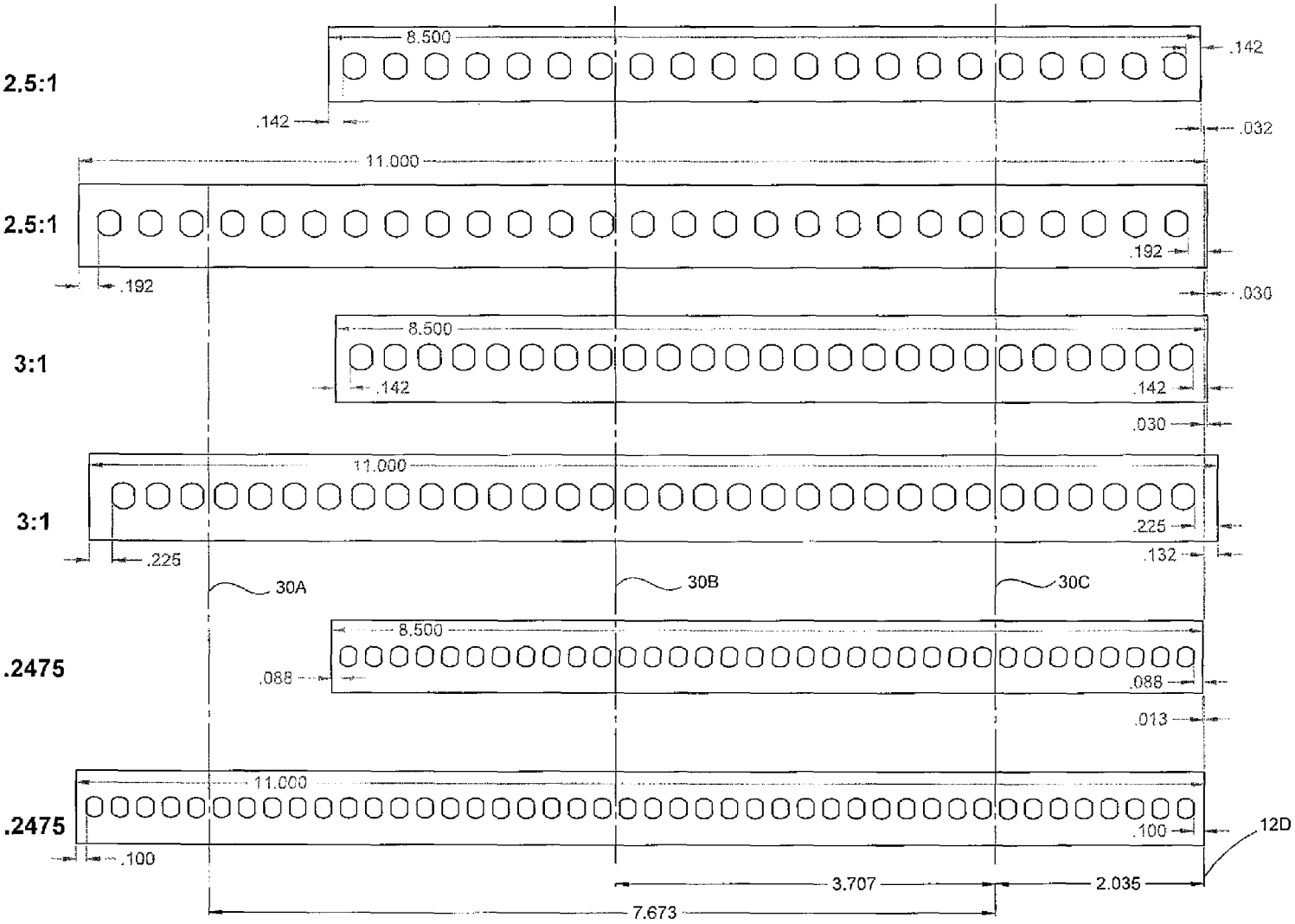
FIG. 7 is a schematic illustration of the three spine former supports and the two spine formers mounted thereon showing the positioning thereof relative to the pitches of different coils.
Figure 9:
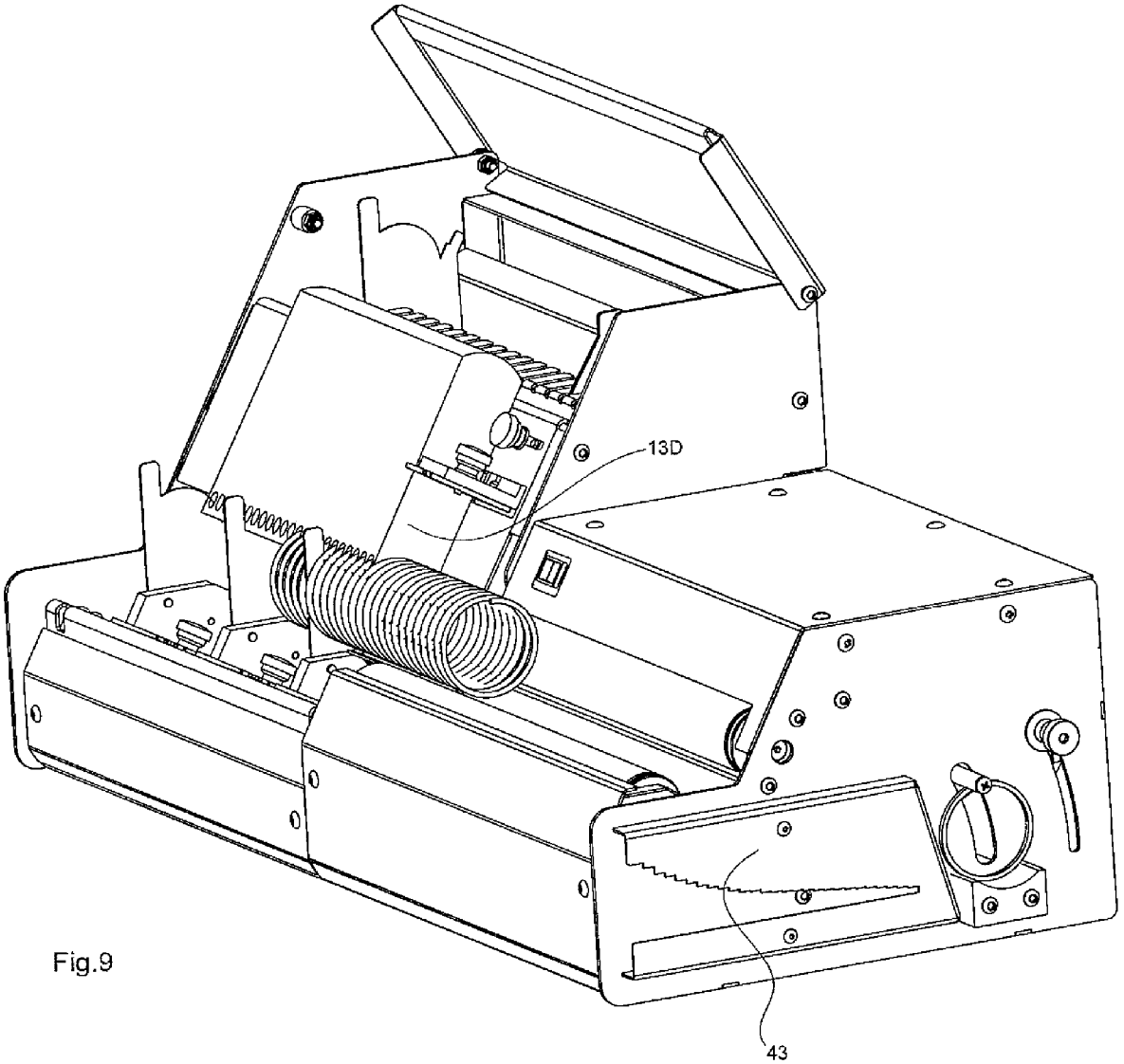
FIG. 9 is an isometric view showing the right side of the machine of FIG. 1

In FIG. 7 is shown the position of the three spine formers 30A, 30B and 30C as spaced from the edge 12D of the book as set by the side lay member 60. It will be noted that the spine formers are located at spaced positions arranged along the length of the edge of the book with the positions selected such that the spine formers allow the passage of each of the three pitches without interfering with movement of the coils.

The method therefore comprises engaging the face 11B of the collated book with the front face of the platen 32 having an edge 32B at which the edge 13 of the book is presented. The helical coil 14 is supported at the edge of the platen 32 and the coil is engaged with the drive rollers 50 and 51 for rotating the helical coil about an axis of the coil parallel to the edge of the platen.

The edge 13 of the book is engaged with a plurality of spine formers 30 arranged at spaced positions along the edge of the platen with each spine former extending across the edge of the book and having an arced surface 30D for shaping the edge of the book into the arced shape so that each of the holes follows a required arc of the hole for receiving the coil.

The end 13D of the book is engaged with a side lay member 60 so as to form the end into an inclined surface at a lay angle to a line at right angles to the platen so as to incline the holes at the angle to receive the turns of the coil.

The flat spine formers 30 are manually rotated on the spine former supports 31 to the required spine former angle as determined by the chart so as to allow the turns of the coil at said pitch angle to pass the spine formers. The spine former supports are arranged to rotate the spine former thereon around the axis along the rear of the book along the edge 30G.

The arced shape of the spine formers is changed by selecting the required spine former from the set in the rack.

The lay angle of the side lay member is adjusted by manually adjustment using the value obtained from the chart.

The platen is adjusted to different platen angles so as to change a distance between the edge of the platen and the drive roller and by the selection of the required spine formers which includes an edge portion thereof engaging the platen 32 at the edge 32B thereof remote from the axis for locating the edge of the platen at the required platen angle.

As shown, the edge of the platen is free from guide teeth so that the coil is not guided in its movement by the platen but instead the coil rotates so that it enters the holes from the front allowing the user to manually adjust the coil position slightly to properly enter and turn. This avoids therefore the necessity to replace the platen and to change the spacing of teeth which must match the pitch.

The spine formers are shaped by the width of the edge 30F up to the front upstanding edge 30J to allow the operator to split the book by pivoting one part of the book about the arced surface of the spine former to improve the clearance for the coil as it is inserted into the book.

The spine former supports 31 are mounted on the spine former mounting member 31E which can be shifted laterally to permit the adjustment of the coil to roller clearance to optimize the coil insertion process and accommodate different coil tolerances or profiles.

The spine former mounting member 31E can also be replaced to provide the location of the pins 31K at different spacings along the book to allow use with different coil pitches.

The invention claimed is:

1. A method for inserting a plastic pre-formed helical coil into aligned holes at an edge of a collated book for binding the book, the book having two opposed faces and two opposed ends between which the edge extends, the helical coil having a plurality of turns extending around an axis of the coil at a pitch angle inclined to a radial plane of the axis;

the method comprising:

engaging one of the opposed faces of the collated book with a support surface of a platen having an edge at which the edge of the book is presented;

supporting the helical coil at the edge of the platen and engaging the coil with a drive roller for rotating the helical coil about an axis of the coil parallel to the edge of the platen;

engaging the edge of the book with a plurality of spine formers arranged at spaced positions along the edge of the platen, each spine former extending across the edge of the book and having an arced surface with an arced shape for shaping the edge of the book into the arced shape so that each of the holes follows a required arc of the hole for receiving the coil;

engaging one of the two opposed ends of the book with a side lay member so as to form said end of the book into an inclined surface at a lay angle to a line at right angles to the platen so as to incline the holes at the lay angle to receive the turns of the coil;

arranging the spine formers on spine former supports at a spine former angle matching the pitch angle of the coil, where the spine former angle is measured with respect to a line at right angles to the faces of the book, in order to allow the turns of the coil at said pitch angle to traverse the spine formers during insertion of the coil through the holes of the book;

wherein the spine formers each at said spine former angle are engaging the edge of the book during said insertion of the coil through the holes of the book;

and, for different thickness of books and different diameter of coils, (i) changing the arced shape of the spine formers, (ii) changing the spine former angle of the spine formers and (iii) changing the lay angle of the side lay member;

wherein each of the spine former supports comprises a pivoting mounting member on which a respective one of the spine formers is rotatable about an upstanding axis transverse to the edge of the platen so as to be set to the spine former angle needed for the book that is to be bound.

2. The method according to claim 1 wherein the spine former supports are rotated to change the spine former angle.

3. The method according to claim 2 wherein the spine former supports are arranged to rotate the spine former thereon around an axis along said one of the opposed faces of the book.

4. The method according to claim 1 wherein there are two spine formers and more than two spine former supports for selection of the supports depending on the length of the edge of the book.

5. The method according to claim 1 wherein there is provided a supply of different spine formers which are separate from the spine former supports and wherein spine formers providing a required arc shape are selected from the supply and mounted on the spine former supports.

6. The method according to claim 1 wherein the spine formers each lie in a flat plane.

7. The method according to claim 1 wherein the spine formers include edges thereof defining a first edge portion forming said arced surface, a second edge portion engaging said one of the opposed faces of the book and a third edge portion engaging said platen.

8. The method according to claim 1 wherein the platen is mounted for pivotal movement about an axis parallel to the edge of the book to different platen angles so as to change a distance between the edge of the platen and the drive roller and wherein the spine formers include an edge portion thereof engaging said platen at an edge thereof remote from the axis for locating the edge of the platen at a required platen angle.

9. The method according to claim 1 wherein the edge of the platen is free from guide teeth so that the coil is not guided in its movement by the platen.

10. The method according to claim 1 wherein the coil is rotated is a direction so that the end of the coil enters the holes from an end of the hole at the face of the book remote from the platen.

11. The method according to claim 10 wherein the end of the coil is guided into the first holes at the front of the book by manual manipulation.

12. The method according to claim 1 wherein there is provided a chart listing a series of different coil sizes and different book thicknesses in conjunction with a list of adjustment positions for manual adjustment of the spine former angle of the spine formers and the lay angle of the side lay member.

13. The method according to claim 12 wherein there is provided a book thickness gauge for providing information relating to the book thickness for the chart.

14. The method according to claim 1 arranged for use with coils at least in the range 10 to 50 mm in diameter.

15. The method according to claim 1 arranged for use with coils having three different pitches and wherein the spine formers are located at spaced positions arranged along the length of the edge of the book with the positions selected such that the spine formers allow the passage of each of the three pitches without interfering with movement of the coils.

16. The method according to claim 1 wherein the pivoting mounting member is designed to rotate about a neutral axis so that the pitch spacing between each spine former and the next is maintained for all coil sizes and pitches.

17. The method according to claim 1 wherein the spine formers are shaped to allow the operator to split the book by pivoting one part of the book about the arced surface of the spine former to improve the clearance for the coil as it is inserted into the book.

18. The method according to claim 1 wherein the spine former supports are mounted on a spine former mounting member which can be shifted laterally to permit the adjustment of the coil to roller clearance to optimize the coil insertion process and accommodate different coil tolerances or profiles.

19. The method according to claim 1 wherein the spine former supports are mounted on a spine former mounting member which can be replaced to allow use with different coil pitches.

20. A method for inserting a plastic pre-formed helical coil into aligned holes at an edge of a collated book for binding the book, the book having two opposed faces and two opposed ends between which the edge extends, the helical coil having a plurality of turns extending around an axis of the coil at a pitch angle inclined to a radial plane of the axis;

the method comprising:

engaging one of the opposed faces of the collated book with a support surface of a platen having an edge at which the edge of the book is presented;

supporting the helical coil at the edge of the platen and engaging the coil with a drive roller for rotating the helical coil about an axis of the coil parallel to the edge of the platen;

engaging the edge of the book with a plurality of spine formers arranged at spaced positions along the edge of the platen, each spine former extending across the edge of the book and having an arced surface with an arced shape for shaping the edge of the book into the arced shape so that each of the holes follows a required arc of the hole for receiving the coil;

engaging one of the two opposed ends of the book with a side lay member so as to form said end into an inclined surface at a lay angle to a line at right angles to the platen so as to incline the holes at the angle to receive the turns of the coil;

arranging the spine formers on spine former supports at a spine former angle to a line at right angles to the faces of the book so as to allow the turns of the coil at said pitch angle to pass the spine formers;

and, for different thickness of books and different diameter of coils, changing the arced shape of the spine formers, changing the spine former angle of the spine formers and changing the lay angle of the side lay member;

wherein the edge of the platen is free from guide teeth so that the coil is not guided in its movement by the platen.

* * * * *